US006597886B1

(12) United States Patent
Yoshida

(10) Patent No.: US 6,597,886 B1
(45) Date of Patent: Jul. 22, 2003

(54) IMAGE FORMING APPARATUS

(75) Inventor: Minoru Yoshida, Machida (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/046,228

(22) Filed: Jan. 16, 2002

(51) Int. Cl.[7] ..... G03G 15/16; G03G 15/00

(52) U.S. Cl. ..... 399/302; 399/167; 399/308

(58) Field of Search ..... 399/75, 167, 302, 399/308, 303, 313, 317, 101; 492/18, 28, 48, 53, 54, 56

(56) References Cited

U.S. PATENT DOCUMENTS

| | | | | |
|---|---|---|---|---|
| 4,705,711 A | * | 11/1987 | Perna | 428/141 |
| 5,187,526 A | | 2/1993 | Zaretsky | 399/302 |
| 5,666,599 A | | 9/1997 | Miyasaka et al. | 399/162 |
| 5,701,568 A | * | 12/1997 | Hiroshima et al. | 399/302 |
| 5,729,788 A | * | 3/1998 | Hirohashi et al. | 399/101 X |
| 5,812,917 A | * | 9/1998 | Iwata et al. | 399/281 |
| 5,970,297 A | * | 10/1999 | Gross | 399/313 |
| 6,055,399 A | * | 4/2000 | Omura | 399/167 |
| 6,212,351 B1 | * | 4/2001 | Kawagoe et al. | 399/302 |
| 6,278,858 B1 | * | 8/2001 | Nakazawa et al. | 399/302 |
| 6,330,407 B1 | * | 12/2001 | Tsukida et al. | 399/302 X |
| 6,349,190 B1 | * | 2/2002 | Liu et al. | 399/302 X |
| 6,456,816 B1 | * | 9/2002 | Chowdry et al. | 399/302 |

FOREIGN PATENT DOCUMENTS

| | | | |
|---|---|---|---|
| JP | 58-086568 | * | 5/1983 |
| JP | 9-146385 | | 6/1997 |

* cited by examiner

*Primary Examiner*—Sophia S. Chen
(74) *Attorney, Agent, or Firm*—Foley & Lardner

(57) ABSTRACT

An image forming apparatus is provided with an image forming device for forming an image of a developing agent on a photosensitive belt, an intermediate transfer drum operating as target of transfer of the developing agent image formed by the image forming device and a transfer roller for transferring the developing agent image transferred to the intermediate transfer drum further to a sheet of paper, the intermediate transfer drum including a base pipe and an elastic belt, of which the base pipe is coated with the elastic belt, the photosensitive belt and the intermediate transfer drum being driven to rotate by a same drive source.

4 Claims, 13 Drawing Sheets

Rubber belt hardness (JIS-A)

| Secondary transfer load (gf/cm) | 50 | 63 | 71 | 80 | 85 | 90 |
|---|---|---|---|---|---|---|
| 7 | ○ | ○ | ○ | ○ | △ | × |
| 12 | ○ | ○ | ○ | ○ | × | × |
| 20 | ○ | ○ | ○ | ○ | × | × |
| 24 | ○ | ○ | ○ | △ | × | × |
| 30 | ○ | ○ | △ | △ | × | × |

| | Initial | 20k | 40k | 60k | 80k | 100k | 120k | 140k | 160k |
|---|---|---|---|---|---|---|---|---|---|
| Condition (1) | ○ | ○ | × | × | × | × | × | × | × |
| Condition (2) | ○ | ○ | ○ | × | × | × | × | × | × |
| Condition (3) | ○ | ○ | ○ | × | × | × | × | × | × |
| Condition (4) | ○ | ○ | ○ | ○ | ○ | ○ | ○ | ○ | ○ |
| Condition (5) | ○ | ○ | ○ | ○ | ○ | ○ | ○ | ○ | ○ |
| Condition (6) | ○ | ○ | ○ | ○ | ○ | ○ | ○ | ○ | ○ |
| Condition (7) | ○ | ○ | ○ | ○ | ○ | ○ | ○ | × | × |

FIG. 11

| | Cleaner | Start | | Life (sheet) |
|---|---|---|---|---|
| | | Contact with intermediary transfer body | Bias | |
| Condition (1) | Blade | Contact | *** | 20 |
| Condition (2) | Blade | Blade separated and immediately contacted | *** | 50 |
| Condition (3) | Blade | Blade separated and contacted 1 sec. after start | *** | 160~ |
| Condition (4) | Brush | Contact | ON | 30 |
| Condition (5) | Brush | Contact | OFF | 105 |
| Condition (6) | Brush | Separate | OFF | 160~ |

FIG. 14

| Cleaning member | Bias | Torque (kg·f) |
|---|---|---|
| Blade | **** | 1.1 |
| Brush | OFF | 0.2 |
| Brush | ON | 1.2 |

FIG. 15

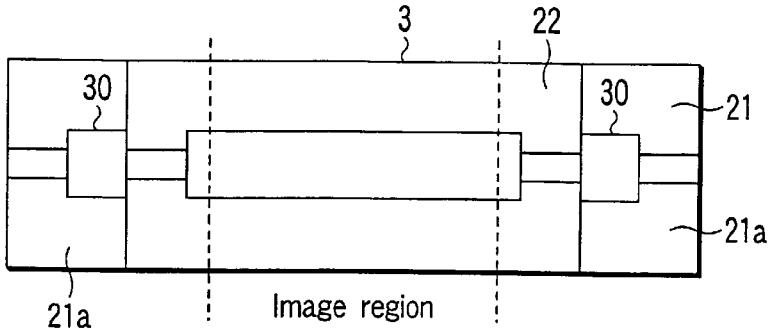
FIG. 19
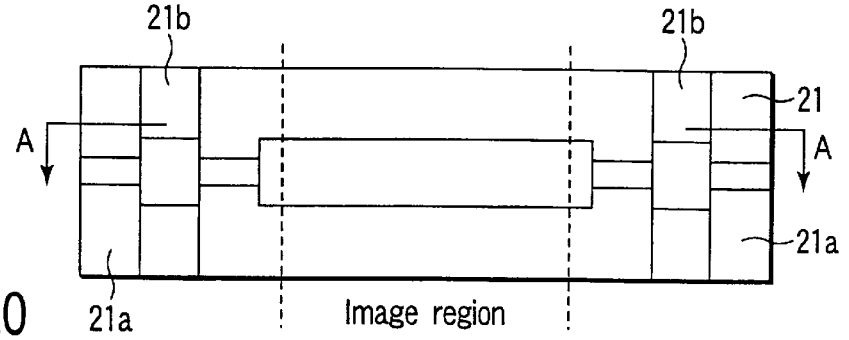
FIG. 20
| Transfer pressure (gf/cm^2) | Inside blanks in stripe image | Defective transfer in life operation | Jams due to defective secondary transfer rotation |
|---|---|---|---|
| 10 | ○ | ○ | × |
| 20 | ○ | ○ | × |
| 30 | ○ | ○ | × |
| 40 | ○ | ○ | × |
| 50 | ○ | ○ | × |
| 60 | ○ | ○ | × |
| 70 | ○ | ○ | × |
| 80 | ○ | ○ | × |
| 90 | × | ○ | × |
| 100 | × | ○ | × |
| 110 | × | × | × |
| 120 | × | × | × |
| 130 | × | × | ○ |
| 140 | × | × | ○ |
| 150 | × | × | ○ |
FIG. 21

| Drive bearing section | | | |
|---|---|---|---|
| Diameter | Hardness | Defective transfer in life operation | Jams due to defective secondary transfer rotation |
| 19.2 | 20 | ○ | × |
| | 25 | ○ | × |
| | 30 | ○ | × |
| | 35 | ○ | × |
| 19.6 | 20 | × | ○ |
| | 25 | ○ | × |
| | 30 | ○ | × |
| | 35 | × | ○ |
| 20 | 20 | × | ○ |
| | 25 | × | ○ |
| | 30 | × | ○ |
| | 35 | × | ○ |
| 20.4 | 20 | × | ○ |
| | 25 | × | ○ |
| | 30 | × | ○ |
| | 35 | × | ○ |

FIG. 22

| Drive bearing section | | | | |
|---|---|---|---|---|
| Diameter | Hardness | Defective contact of transfer roller | Defective transfer in life operation | Jams due to defective secondary transfer rotation |
| 20.2 | 20 | ○ | ○ | × |
| | 25 | ○ | ○ | × |
| | 30 | ○ | ○ | × |
| | 35 | ○ | ○ | × |
| | 40 | ○ | ○ | × |
| 20.6 | 20 | ○ | ○ | × |
| | 25 | ○ | ○ | × |
| | 30 | ○ | ○ | ○ |
| | 35 | ○ | ○ | ○ |
| | 40 | ○ | ○ | ○ |
| 21 | 20 | ○ | ○ | ○ |
| | 25 | ○ | ○ | ○ |
| | 30 | ○ | ○ | ○ |
| | 35 | ○ | ○ | ○ |
| | 40 | ○ | ○ | ○ |
| 21.4 | 20 | ○ | ○ | ○ |
| | 25 | ○ | ○ | ○ |
| | 30 | ○ | ○ | ○ |
| | 35 | × | ○ | ○ |
| | 40 | × | ○ | ○ |

FIG. 23

FIG. 24

| Drive bearing section | | | | |
|---|---|---|---|---|
| Diarneter | Hardness | Defective contact of transfer roller | Defective transfer in life operation | Jams due to defective secondary transfer rotation |
| 20.2 | 20 | ○ | ○ | × |
| | 25 | ○ | ○ | × |
| | 30 | ○ | ○ | × |
| | 35 | ○ | ○ | × |
| | 40 | ○ | ○ | × |
| 20.6 | 20 | ○ | ○ | × |
| | 25 | ○ | ○ | × |
| | 30 | ○ | ○ | × |
| | 35 | ○ | ○ | × |
| | 40 | ○ | ○ | ○ |
| 21 | 20 | ○ | ○ | ○ |
| | 25 | ○ | ○ | ○ |
| | 30 | ○ | ○ | ○ |
| | 35 | ○ | ○ | ○ |
| | 40 | ○ | ○ | ○ |
| 21.4 | 20 | ○ | ○ | ○ |
| | 25 | ○ | ○ | ○ |
| | 30 | ○ | ○ | ○ |
| | 35 | × | ○ | ○ |
| | 40 | × | ○ | ○ |

| Rubber hardness (JIS-A) | Pitch of arrangement of knurls | Defective transfer after 500k sheets in life operation |
|---|---|---|
| 78 | 1 | × |
| | 2 | ○ |
| | 3 | ○ |
| | 5 | ○ |
| | 7 | ○ |
| | 10 | ○ |
| | 15 | ○ |
| | 20 | ○ |
| | 30 | × |
| 63 | 1 | × |
| | 2 | ○ |
| | 3 | ○ |
| | 5 | ○ |
| | 7 | ○ |
| | 10 | ○ |
| | 15 | ○ |
| | 20 | ○ |
| | 30 | × |

FIG. 27

FIG. 28

| Rubber hardness (JIS-A) | Pitch of arrangement of knurls (mm) | Width of knurl (mm) | Initial defective transfer | Defective transfer after 500k sheets in life operation |
|---|---|---|---|---|
| 78 | 2 | 0.02 | × | ****** |
| | | 0.05 | ○ | ○ |
| | | 0.1 | ○ | ○ |
| | | 0.2 | ○ | ○ |
| | | 0.5 | ○ | ○ |
| | | 1 | ○ | ○ |
| | | 2 | × | ****** |
| | 20 | 0.02 | × | ****** |
| | | 0.05 | ○ | ○ |
| | | 0.1 | ○ | ○ |
| | | 0.2 | ○ | ○ |
| | | 0.5 | ○ | ○ |
| | | 1 | ○ | ○ |
| | | 2 | × | ****** |
| 63 | 2 | 0.02 | ○ | ○ |
| | | 0.05 | ○ | ○ |
| | | 0.1 | ○ | ○ |
| | | 0.2 | ○ | ○ |
| | | 0.5 | ○ | ○ |
| | | 1 | ○ | ○ |
| | | 2 | × | ****** |
| | 20 | 0.02 | ○ | ○ |
| | | 0.05 | ○ | ○ |
| | | 0.1 | ○ | ○ |
| | | 0.2 | ○ | ○ |
| | | 0.5 | ○ | ○ |
| | | 1 | ○ | ○ |
| | | 2 | × | ****** |

FIG. 29

| Rubber hardness (JIS-A) | Pitch of arrangement of knurls (mm) | Width of knurl (mm) | Initial defective transfer | Defective transfer after 500k sheets in life operation |
|---|---|---|---|---|
| 78 | 2 | 0.02 | ○ | × |
| | | 0.03 | ○ | × |
| | | 0.05 | ○ | ○ |
| | | 0.1 | ○ | ○ |
| | | 0.2 | ○ | ○ |
| | | 0.3 | × | ****** |
| | | 0.4 | × | ****** |
| | 20 | 0.02 | ○ | × |
| | | 0.03 | ○ | × |
| | | 0.05 | ○ | ○ |
| | | 0.1 | ○ | ○ |
| | | 0.2 | ○ | ○ |
| | | 0.3 | × | ****** |
| | | 0.4 | × | ****** |
| 63 | 2 | 0.02 | ○ | × |
| | | 0.03 | ○ | × |
| | | 0.05 | ○ | ○ |
| | | 0.1 | ○ | ○ |
| | | 0.2 | ○ | ○ |
| | | 0.3 | × | ****** |
| | | 0.4 | × | ****** |
| | 20 | 0.02 | ○ | × |
| | | 0.03 | ○ | × |
| | | 0.05 | ○ | ○ |
| | | 0.1 | ○ | ○ |
| | | 0.2 | ○ | ○ |
| | | 0.3 | × | ****** |
| | | 0.4 | × | ****** |

| Width of knurls (mm) | Depth of knurls (mm) | Rubber hardness (JIS-A) | Initial defective transfer | Defective transfer after 500k sheets in life operation |
|---|---|---|---|---|
| 0.05 | 0.05 | 41 | ○ | × |
| | | 50 | ○ | × |
| | | 61 | ○ | ○ |
| | | 68 | ○ | ○ |
| | | 77 | ○ | ○ |
| | | 83 | ○ | ○ |
| | | 90 | ○ | ○ |
| 1 | 0.2 | 41 | ○ | × |
| | | 50 | ○ | × |
| | | 61 | ○ | ○ |
| | | 68 | ○ | ○ |
| | | 77 | ○ | ○ |
| | | 83 | × | ***** |
| | | 90 | × | ***** |

IMAGE FORMING APPARATUS

BACKGROUND OF THE INVENTION

This invention relates to an image forming apparatus having applications as color printing apparatuses.

Various color printing apparatus are known and adapted to form an image by laying toner images of different colors one on the other. The image may be formed on a photosensitive body, a sheet of paper, on an intermediate transfer body or some other recording medium.

The method of laying toner images one on the other on a photosensitive body is accompanied by a disadvantage of poor image quality because the toner images have to be exposed to light.

The method of laying toner images one on the other on a sheet of paper has been popularly used for long. This transfer method provides an advantage that the toner images are transferred only once as compared with the intermediate transfer method by which the toner images need to be transferred twice. Hence, this method has been employed in various color copying machines.

On the other hand, the intermediate transfer method that has been regarded as disadvantageous in terms of image quality has been employed in color printers that do not required a very high image quality because it provides an advantage of requiring only a small space if the intermediate transfer body is realized in the form of a belt and that of applicability of cardboard.

The intermediate transfer body may be realized in the form of a belt or a drum.

An intermediate transfer body in the form of a drum (to be referred to as intermediate transfer drum hereinafter) is typically prepared by coating the surface of a base metal pipe with a rubber belt.

Problems occur when the rubber belt slides on the base pipe. The problems include relative displacements of different colors and defective or uneven transfers of toner images due to a warped and lifted rubber belt. The rubber belt can be warped mainly due to the load torque at the primary transfer nip of the intermediate transfer drum and the photosensitive body, the contact load of the secondary transfer roller in the secondary transfer process and/or the load torque of the cleaner contacting the intermediate transfer drum.

The system where the intermediate transfer drum is not equipped with a dedicated drive source and adapted to follow the rotary movement of the photosensitive body provides an advantage of scarcely producing color displacements because both the photosensitive body and the intermediate transfer drum revolve substantially at a same rate.

However, with this system, the surface of the intermediate transfer drum is subjected to a large twisting force at the primary transfer nip when the photosensitive body or the intermediate transfer drum starts rotating. If such a condition repeatedly appears, the rubber belt can be lifted from the base pipe to give rise to a problem of defective transfer.

If the intermediate transfer drum is equipped with a dedicated drive source, the rubber belt can become lifted from the base pipe to give rise to a problem of defective transfer as a result of repeated use when the photosensitive body and the intermediate transfer drum revolve at respective rates that are different from each other when they start rotating.

In printing apparatuses where a blade cleaner is held in contact with the secondary transfer roller, the surface of the intermediate transfer drum can be subjected to a large twisting force when the load torque of secondary transfer roller is large and the secondary transfer roller is made to contact the intermediate transfer drum.

When a blade is used as a cleaner for the intermediate transfer drum, the surface of the intermediate transfer drum can be subjected to a large twisting force to lift the rubber belt due to the load torque of the blade.

Therefore, when coating the base pipe with a rubber belt, a technique of applying an adhesive agent between the base pipe and the rubber belt is usually used in order to prevent the rubber belt from sliding on the base pipe.

However, unless the adhesive agent is uniformly applied between the base pipe and the rubber belt, the surface of the intermediate transfer drum shows undulations to give rise to uneven transfers, which prevents efforts for improving the yield and realizing mass production.

Uniform transfers will be realized to improve the yield if the base pipe can be coated with a rubber belt without any adhesive agent. Then, the elastic rubber belt needs to be expanded maximally before the base pipe is coated with it in order to prevent the rubber belt from sliding on the surface of the base pipe without using any adhesive agent.

However, if the rubber belt is expanded excessively, its elasticity will become lost as it is used for a long time. Then, it will slide on the base pipe. Additionally, expanding the highly elastic rubber belt excessively to produce an intermediate transfer body will constitute a manufacturing problem.

BRIEF SUMMARY OF THE INVENTION

In view of the above identified circumstances, it is therefore the object of the present invention to provide an image forming apparatus in which the elastic belt will not slide on the base pipe if the base pipe is coated with the elastic belt by expanding the latter excessively.

In an aspect of the invention, the above object is achieved by providing an image forming apparatus comprising an image forming device which forms an image of a developing agent on an image carrier; a freely rotatable intermediate transfer body to which the developing agent image formed by the image forming device is to be transferred and a freely rotatable transfer roller which transfers the developing agent image from the intermediate transfer body further to a final target of transfer, the intermediate transfer body comprising a base pipe and an elastic belt, the base pipe being coated with the elastic belt, the image carrier and the intermediate transfer body being driven to rotate by a same drive source.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 11 is a chart showing the evaluation of transfers of images with blank areas occurring in the sheets of every 20 k in a printing test;

FIG. 14 is a chart illustrating the transfer performance of the embodiment in a life operation conducted under various cleaning conditions;

FIG. 15 is a chart illustrating the change in the torque when a bias voltage is applied to the cleaner and when no bias voltage is applied to the cleaner;

FIG. 19 is a schematic illustration of the bearing rollers coaxially connected to the secondary transfer roller and brought into contact with the exposed area of the base pipe of the intermediate transfer drum;

FIG. 20 is a schematic illustration of the bearing rollers coaxially connected to the secondary transfer roller and brought into contact with the exposed high friction area of the base pipe of the intermediate transfer drum;

FIG. 21 is a chart illustrating the transfer performance of the embodiment when the mode of FIG. 17 is used;

FIG. 22 is a chart illustrating the transfer performance of the embodiment when the mode of FIG. 18 is used;

FIG. 23 is a chart illustrating the transfer performance of the embodiment when the mode of FIG. 19 is used;

FIG. 24 is a chart illustrating the transfer performance of the embodiment when the mode of FIG. 20 is used;

FIG. 27 is a chart illustrating the effect of the pitch of arrangement of knurls on the transfer performance when the width and the depth of the knurls are held to 100 $\mu$m;

FIG. 28 is a chart illustrating the effect of the width of the knurls on the transfer performance when the depth of the knurls is held to 1 mm;

FIG. 29 is a chart illustrating the effect of the depth of the knurls on the transfer performance when the width of the knurls is held to 2 mm;

DETAILED DESCRIPTION OF THE INVENTION

Now, the present invention will be described by referring to the accompanying drawing that illustrates preferred embodiments of the invention.

Figure 1:
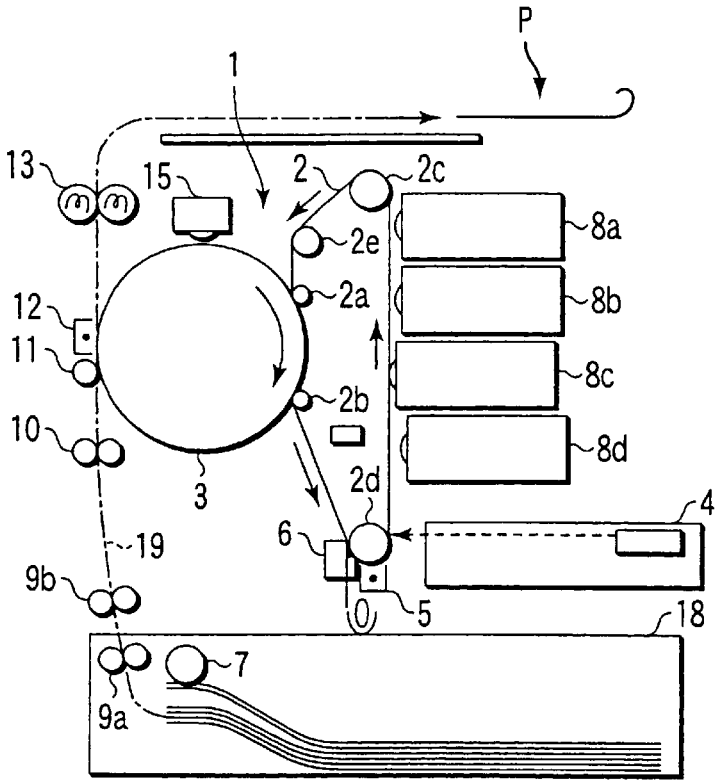
FIG. 1 is a schematic illustration of the inside of an electronic photocopying machine that is the first embodiment of the invention.

FIG. 1 is a schematic illustration of an electronic photocopying machine that is the first embodiment of the invention, showing its configuration.

The electronic photocopying machine comprises an image forming section 1 that shows a processing rate of 180 mm/sec. The image forming section 1 includes a photosensitive belt 2 operating as image carrier, a charging unit 5 for electrically charging the photosensitive belt 2 to a predetermined electric potential and an exposure unit 4 for forming an electrostatic latent image on the electrically charged photosensitive belt 2.

Additionally, the image forming section 1 has first through fourth developing units 8*a* through 8*d* for supplying toner as developing agent to the electrostatic latent image formed on the photosensitive belt 2 by the exposure unit 4 and developing it and an intermediate transfer drum 3 operating as intermediate transfer body for temporarily carrying the toner image formed on the photosensitive belt 2 by the developing units 8*a* through 8*d*.

Furthermore, the image forming section 1 has a cleaner 15 for cleaning the intermediate transfer drum 3 and a cleaning unit 6 for removing the toner remaining on the photosensitive belt 2.

The photosensitive belt 2 is wound around first through fifth rollers 2*a* through 2*e* so as to show a predetermined level of tension. The part of the photosensitive belt 2 extending between the first and second rollers 2*a*, 2*b* is held in tight contact with the outer peripheral surface of the intermediate transfer drum 3. The part of the photosensitive belt 2 extending between the third and fifth rollers 2*c* and 2*e* is separated from the developing units 8*a* through 8*d* by a predetermined gap. As any of the first through fifth rollers 2*a* through 2*e* is driven by a drive motor 20, which will be described hereinafter, the photosensitive belt 2 is driven to move at a predetermined rate in the sense indicated by arrows.

A sheet cassette 18 containing sheets P of predetermined dimensions that operate as targets of image transfer is arranged below the image forming section 1. The sheet cassette 18 is provided with a paper feeding roller 7 for taking out a sheet at a time. A conveyor system 19 is arranged between the sheet cassette 18 and the intermediate transfer drum 3 in order to convey sheets P toward the intermediate transfer drum 3.

A pair of conveyor rollers 9*a*, 9*b*, an aligning roller 10 and a transfer roller 11 are arranged sequentially in the conveyor system 19 along the direction of conveying sheets P. The aligning roller 10 is adapted to temporarily stop each sheet P that is being conveyed and eliminate any inclination thereof relative to its moving direction. It also aligns the front end of each sheet P and the front end of the toner image on the intermediate transfer drum 3.

A separation unit 12 for applying an AC charge to the sheet P to which a toner image is transferred in order to peel it off from the intermediate transfer drum 3 and a fixing unit 13 for fixing the toner image transferred to the sheet P to the latter are arranged downstream to the transfer roller 11 along the moving direction of the sheet. The sheet conveyed by the conveyor system 19 is then pinched between the intermediate transfer drum 3 and the transfer roller 11 and a toner image is transferred to it by the effect of the electric field between the intermediate transfer drum 3 and the transfer roller 11.

Now, the operation of printing a full color image of the above described image forming apparatus will be described.

Firstly, the surface of the rotating photosensitive belt 2 is uniformly charged with electricity by the charging unit 5. Subsequently, an exposure operation corresponding to a yellow image is performed on the photosensitive belt 2 by the exposure unit 4 to form an electrostatic latent image. The electrostatic latent image is moved to the yellow developing unit 8*a* as a result of the rotary movement of the photosensitive belt 2 to face the latter. Then, it is developed as yellow toner is supplied from the yellow developing unit 8*a*. The developed toner image is transferred onto the intermediate transfer drum 3 for primary transfer as a result of the rotary movement of the photosensitive belt 2. The primary transfer of the toner image from the photosensitive belt 2 to the intermediate transfer drum 3 is realized by the effect of the difference between the electric potential of the substrate at the back of the photosensitive belt 2 and the base pipe of the intermediate transfer drum 3.

In this embodiment, the electric potential of the substrate at the back of the photosensitive belt 2 is 0V and a bias voltage within a range between +600 and +1,200V is applied to the base pipe of the intermediate transfer drum 3, the bias voltage being selected as a function of the environment or operation history of the intermediate transfer drum 3.

After passing through the transfer region, the photosensitive belt 2 is optically discharged by a discharger and the toner remaining on the photosensitive belt 2 without having been transferred to the intermediate transfer drum 3 is removed by the cleaner 6. The toner removed by the cleaner is collected in a waste toner box.

The discharged photosensitive belt 2 is electrically recharged by the charging unit 5 and an exposure operation corresponding to a magenta image is performed by the exposure unit 4 to form an electrostatic latent image. The electrostatic latent image is moved to the magenta developing unit 8*b* as a result of the rotary movement of the photosensitive belt 2 to face the latter. Then, the magenta toner image is developed as magenta toner is supplied from the magenta developing unit 8*b*. The developed toner image is transferred onto the yellow image on the intermediate transfer drum 3 as a result of the rotary movement of the photosensitive belt 2. Thereafter, the above process is repeated for a cyan image and a black image to produce an image on the intermediate transfer drum 3 by laying images of four different colors one on the other.

After forming an image obtained by laying images of four different colors one on the other, a sheet P is supplied between the intermediate transfer drum 3 and the transfer roller 11 and the toner image formed by laying images of four different colors one on the other is collectively transferred onto the sheet P, the transfer being referred to as secondary transfer. After the transfer, the sheet P is peeled off from the intermediate transfer drum 3 by the separation charger 12 and sent to the fixing unit 13, where the toner image is fixed to produce a color image.

On the other hand, after the operation of transferring the toner image from the intermediate transfer drum 3 to the sheet P, the toner that has not been transferred onto the sheet P remains on the intermediate transfer drum 3. The residual toner is removed by the cleaner 15 and the intermediate transfer drum 3 is cleaned.

The cleaner 15 is arranged in such a way that it can be brought to contact with and moved away from the intermediate transfer drum 3. When four images of different colors are formed on the intermediate transfer drum 3 in a manner as described above, it is held away from the intermediate transfer drum 3.

While the secondary transfer roller 11 is not provided with a cleaning means, it is brought into contact with the intermediate transfer drum 3 before the start and after the end of a printing cycle in a state where a bias voltage showing the same polarity as that of the toner (−polarity) is applied thereto. As a result, the toner adhering to the secondary transfer roller 11 is moved back to the intermediate transfer drum 3 and collected by the cleaner 15.

The cleaner 15 is a brush cleaner. The brush cleaner is a known electro-conductive brush prepared by using fibers obtained by dispersing carbon in rayon or nylon. The ratio of the revolutions per unit time of the cleaner 15 to that of the intermediate transfer drum 3 is minimized and held to about 1.3 in terms of "with rotation" so that the load on the surface of the intermediate transfer drum produced by the cleaning operation is very small.

Figure 2:
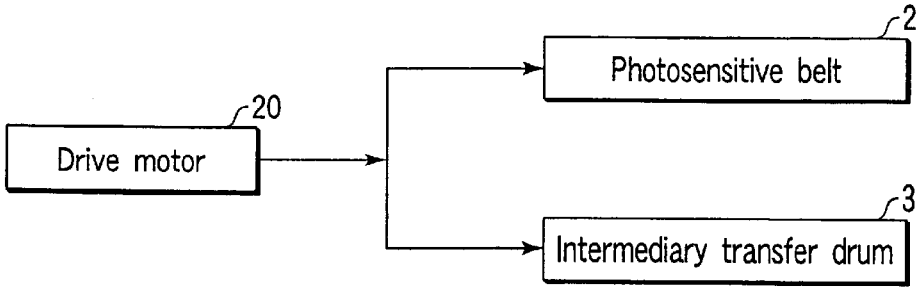
FIG. 2 is a schematic block diagram of the drive system of the photosensitive belt and the intermediate transfer drum of the embodiment.
Figure 4:
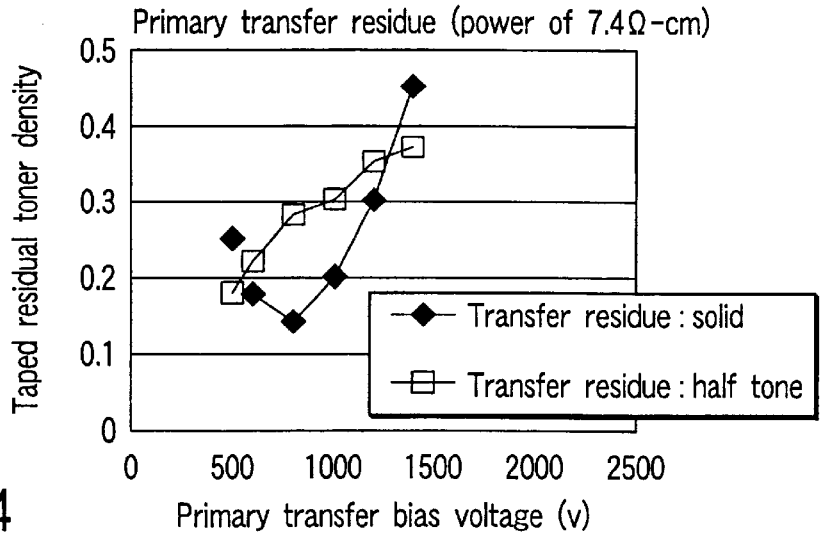
FIG. 4 is a graph showing the residual toner density immediately after the primary transfer.
Figure 5:
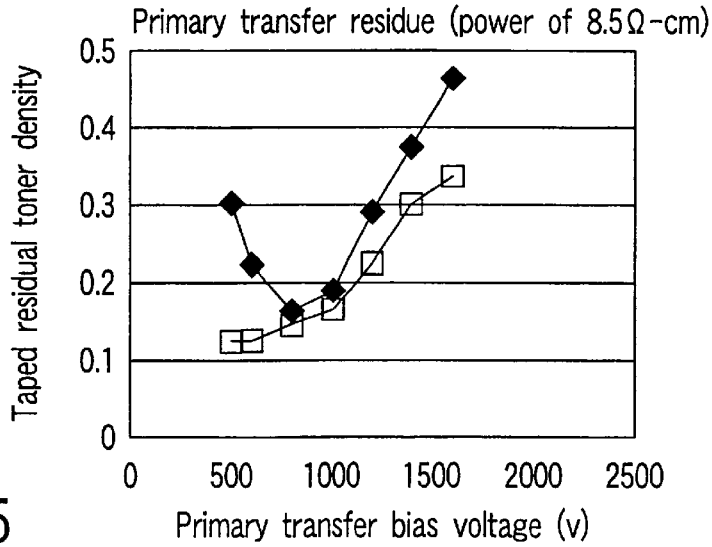
FIG. 5 is a graph showing the residual toner density immediately after the primary transfer.
Figure 6:
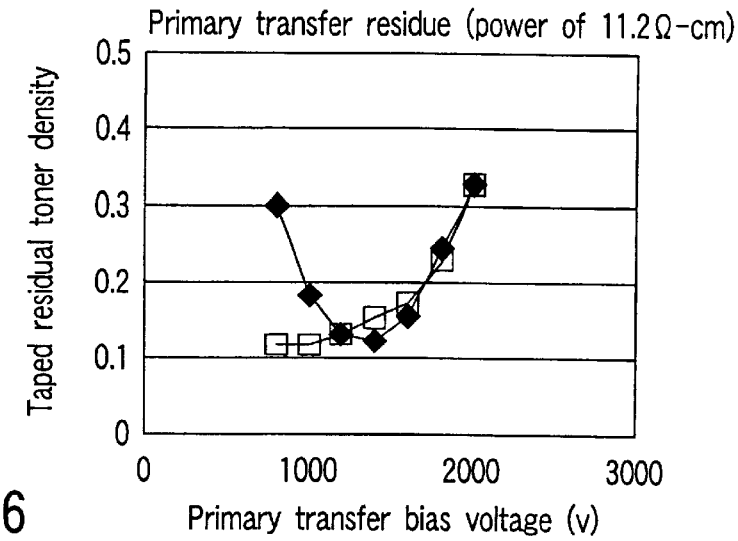
FIG. 6 is a graph showing the residual toner density immediately after the primary transfer.
Figure 7:
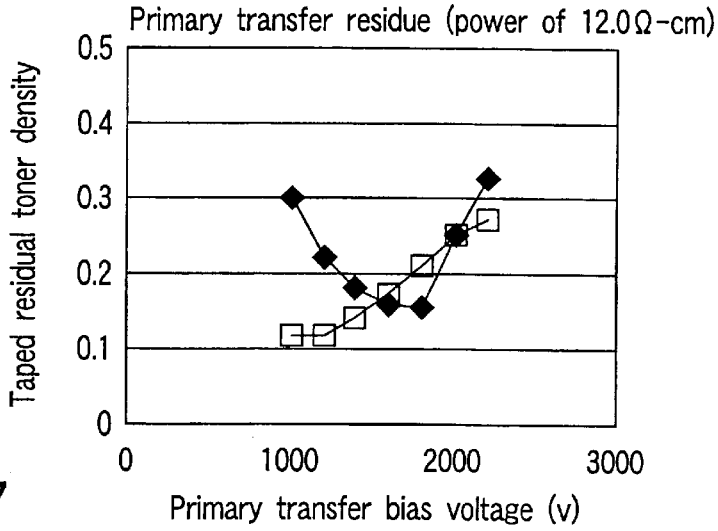
FIG. 7 is a graph showing the residual toner density immediately after the primary transfer.
Figure 8:
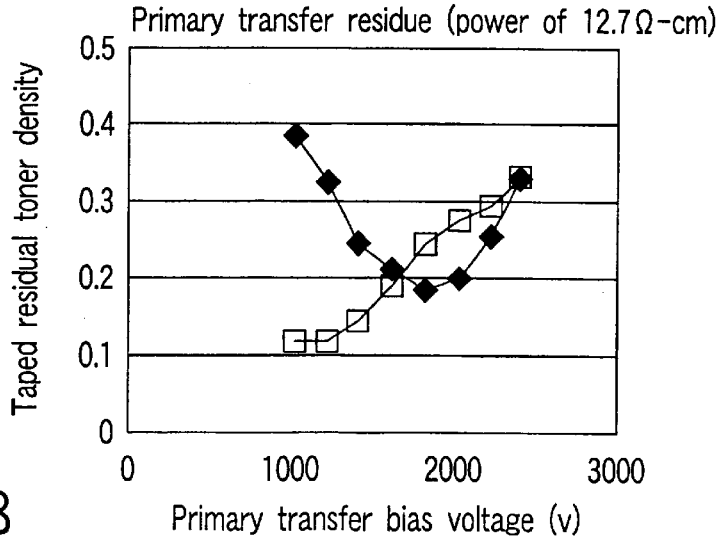
FIG. 8 is a graph showing the residual toner density immediately after the primary transfer.

FIG. 2 is a schematic block diagram of the drive system of the photosensitive belt 2 and the intermediate transfer drum 3 of the embodiment. The intermediate transfer drum 3 and the photosensitive belt 2 are driven to rotate by a common drive motor 20.

Figure 3:
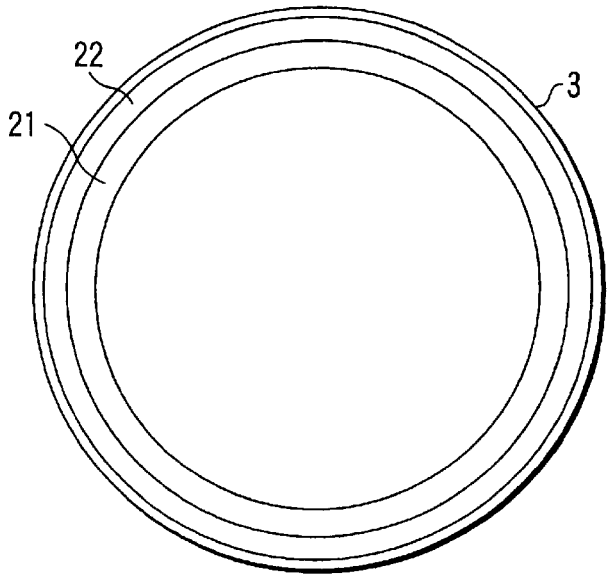
FIG. 3 is a schematic cross-sectional view of the intermediate transfer drum of the embodiment.

FIG. 3 is a schematic cross-sectional view of the intermediate transfer drum 3 of the embodiment.

The intermediate transfer drum 3 has a structure formed by coating an aluminum base pipe 21 with an outer diameter of 169 mm with a rubber belt 22 having a thickness of t=0.5 mm. The outer diameter after coating with the rubber belt 22 is about 170 mm. Since the rubber belt 22 is expanded, the outer diameter is slightly smaller than 170 mm to be accurate.

The rubber belt 22 is typically prepared by applying fluorine rubber, Teflon resin, nylon paint, urethane paint or the like that can release toner well onto the surface of rubber such as chloroprene rubber, EPDM, urethane, NBR, silicone rubber or elastomer.

The rubber belt 22 of this embodiment is realized by coating the surface of chloroprene with fluorine rubber to a thickness of 10 $\mu$m. If the rubber belt 22 covering the base pipe 21 is too thin, it can be drawn easily and give rise to a problem of defective transfer due to a lifted rubber belt 22. The rubber belt 22 can hardly slide on the base pipe 21 and become warped and lifted if the surface of the intermediate transfer drum 3 is forced to bear a load for various reasons when it shows a high tensile strength and the difference between its inner diameter and the outer diameter of the base pipe 21 is large.

On the other hand, however, the preparation of the intermediate transfer drum 3 will be difficult if a belt showing an excessively high tensile strength needs to be forcibly drawn to cover the base pipe 21. Additionally, the rubber belt will lose elasticity as it is used for a long time to give rise to a problem of defective transfer in the final stages of its service life because the rubber belt becomes lifted.

Generally, a rubber belt having a thickness between 0.2 and 1.2 mm and a 100% tensile stress between 40 and 300 ($kgf/cm^2$) is used with a drawing ratio of P=1.03 to 1.15, where P stands for the ratio of the outer diameter R of the aluminum base pipe to the inner diameter r of the rubber belt.

FIGS. 4 through 8 are graphs illustrating the relationship between the resistance of the intermediate transfer drum 3 and the untransferred residual amount (solid, half tone) of toner on the photosensitive belt 2 after the primary transfer.

The resistance of the intermediate transfer drum 3 is observed by means of Hiresta (tradename); available from Mitsubishi Chemical Industries using probe HRSS, applying 1,500V for 30 sec.

The untransferred residual amount is observed (by means of a Macbeth densitometer) by developing the magenta toner of a solid area of 0.7 $mg/cm^2$ and a half tone area of 0.25 $mg/cm^2$, taping the residual toner on the photosensitive belt 2 after the primary transfer and applying it to white paper.

It will be appreciated that proper transfer operations are carried out when the volume resistivity is found within a range between $10^8$ and $10^{12}$ Ω·cm, although the right bias voltage may differ.

Figures 9, 10:
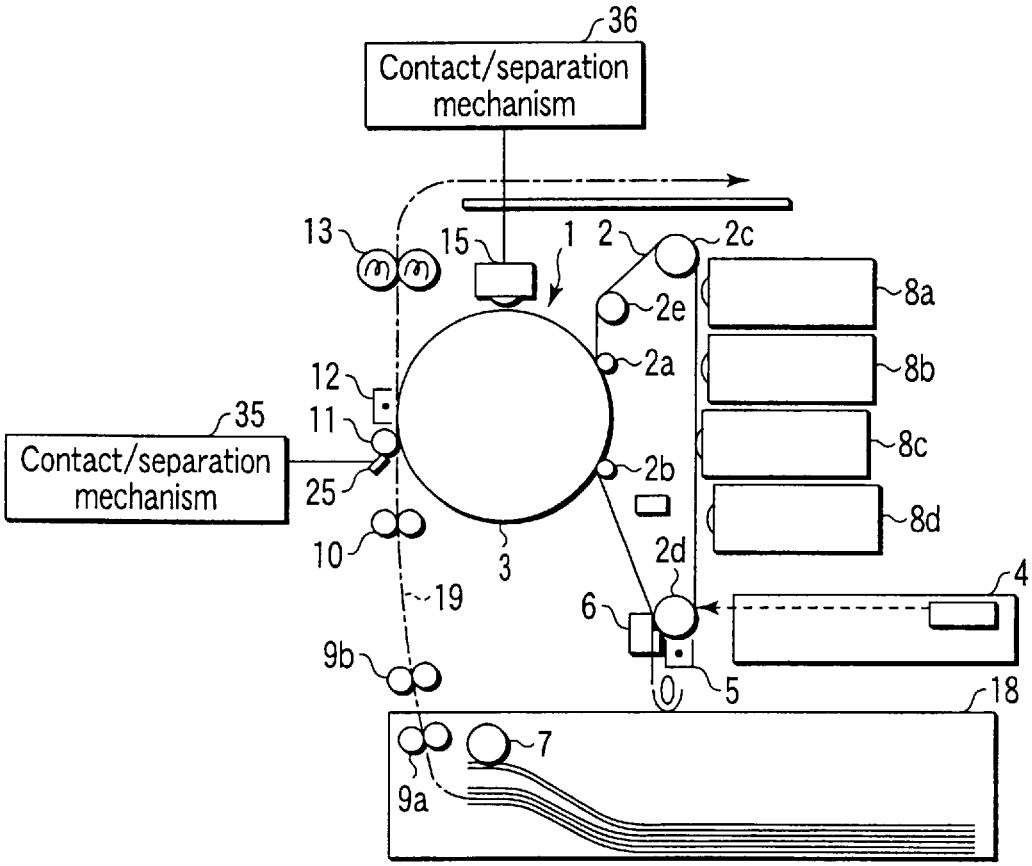
FIG. 9 is a chart showing the evaluation of inside blanks of printed strips.
FIG. 10 is a schematic illustration of the inside of an electronic photocopying machine that is the second embodiment of the invention.

FIG. 9 is a chart showing the evaluation of inside blanks of printed strips made in terms of the rubber hardness (JIS-A) of the rubber belt 22.

In an experiment conducted for the evaluation, a 35-degree (ASKER-C) urethane sponge roller was used for the secondary transfer roller 11 and the transfer pressure was made to vary within a range between 7 and 30 g to transfer 300 μm-wide longitudinal strips (running in the sub-scanning direction) that are most apt to produce inside blanks when printed.

In FIG. 9, Δ and ○ indicate acceptable ratings in terms of inside blanks.

It will be appreciated by seeing the chart that inside blanks can occur as a result of transfer when the rubber hardness is high. Therefore, the rubber hardness (JIS-A) of the coating rubber belt 22 has to be not higher than 80 degrees.

In this embodiment, an intermediate transfer drum 3 showing a volume resistivity of $1\times10^{10}$ Ω·cm, a hardness of 70 degrees, a thickness of 0.5 mm, a 100% tensile stress of 280 $g/cm^2$ and a drawing ratio of P=1.12 and comprising a base pipe 21 made of aluminum (without surface treatment) is used. These are requirements to be met for the rubber belt 22 to firmly hold the base pipe 21.

In a printing experiment using this embodiment where 100 k sheets were used one by one for printing with time intervals, no problem of defective transfer due to a warped and lifted rubber belt 22 occurred.

However, with this embodiment, while no defective transfer occurred initially, it occurred after printing 30 k sheets when the photosensitive belt 2 and the intermediate transfer drum 3 were driven to rotate by respective drive motors in a life operation.

This is attributable to the fact that the photosensitive belt 2 and the intermediate transfer drum 3 are driven to rotate at different respective rates at the very start.

It was tried to synchronize the starting operation of the photosensitive belt 2 and that of the intermediate transfer drum 3 in terms of the rates at which they were driven to rotate respectively. However, it was found that the load of the photosensitive belt 2 and that of the intermediate transfer drum 3 change depending on the environment and the life conditions so that it is difficult to make their rates of rotation completely agree with each other. While the situation may be improved to some extent, it is not possible to intermittently print more than 100 k sheets one by one with time intervals without being accompanied by defective transfers.

Since the photosensitive belt 2 and the intermediate transfer drum 3 of this embodiment are driven to rotate by a common motor 20 as pointed out above, the starting operation of the photosensitive belt 2 and that of the intermediate transfer drum 3 are synchronized in terms of the rates at which they are driven to rotate respectively. Therefore, it is possible to intermittently print more than 100 k sheets one by one with time intervals without being accompanied by defective transfers.

FIG. 10 is a schematic illustration of the inside of an electronic photocopying machine that is the second embodiment of the invention.

Note that the components that are same as or similar to those of the first embodiment are denoted respectively by the same reference symbols and will not be described any further.

While the second embodiment is basically identical with the first embodiment, it differs from the first embodiment in that the blade cleaner 25 is held in contact with the secondary transfer roller 11. The blade cleaner can be moved away from the secondary transfer roller 11 by means of a contact/separation mechanism 35.

The secondary transfer roller 11 can be by turn brought into contact with and moved away from the intermediate transfer drum 3 by another contact/separation mechanism 36. The secondary transfer roller 11 is held in a state where it is totally separated from the intermediate transfer drum 3 during the operation of transferring images from the photosensitive belt 2 to the intermediate transfer drum 3 and laying on the latter on a one on the other basis because the secondary transfer roller 11 can disturb the images on the intermediate transfer drum 3 when it is held in contact with the latter.

As a full-color image is formed on the intermediate transfer drum 3 by using four colors, a sheet of paper is supplied to the secondary transfer position and aligned with the front end of the image. The secondary transfer roller 11 is brought into contact with the intermediate transfer drum 3 immediately before the sheet of paper gets to the secondary transfer position.

Meanwhile, as the blade cleaner 25 is brought into contact with the secondary transfer roller 11, the load torque of the secondary transfer roller 11 increases. Therefore, the rubber belt 22 covering the intermediate transfer drum 3 is forced to bear a large load on the surface thereof at the moment when the secondary transfer roller 11. Then, the warp of the rubber belt 22 develops with the progress of the service life of the intermediate transfer drum 3 and consequently the rubber belt 22 is lifted due to the warp to give rise to defective transfers.

The occurrence of blank areas in the every 20 k-th sheet was checked and evaluated in a printing test using 160 k sheet under seven different conditions for driving the secondary transfer roller 11 and making it contact with the blade cleaner 25 as listed below.

FIG. 11 summarizes the obtained results. Condition (1): The secondary transfer roller 11 was made to follow the rotary movement of the intermediate transfer drum 3.

Condition (2): The secondary transfer roller 11 was driven to rotate by a drive source different from that of the intermediate transfer drum 3.

Condition (3): The secondary transfer roller was commonly driven by the drive source of the intermediate transfer drum 3 and the clutch was turned ON after the contact with the intermediate transfer drum 3.

Condition (4): The secondary transfer roller 11 was commonly driven by the drive source of the intermediate transfer drum 3 and made to contact the intermediate transfer drum 3 after the clutch was turned ON.

Condition (5): The secondary transfer roller 11 was driven to rotate by a drive source different from that of the intermediate transfer drum 3 and made to contact the intermediate transfer drum 3 after getting to a predetermined velocity.

Condition (6): The secondary transfer roller 11 was made to follow the rotary movement of the intermediate transfer drum 3 and the blade cleaner 25 was separated form the secondary transfer roller 11 when the latter was made to contact the intermediate transfer drum 3.

Condition (7): The secondary transfer roller 11 was driven independently from the intermediate transfer drum 3 and made to contact the latter while it was rotating but the blade cleaner 25 was separated from the secondary transfer roller 11 when the latter was made to contact the intermediate transfer drum 3.

Under the conditions (1) through (3), defective transfers occur before 100 k sheets have been used successfully for printing. On the other hand, more than 100 k sheets can be used successfully for printing under the conditions (4) through (7). In other words, no problem arises when the secondary transfer roller 11 is driven to rotate before it is made to contact the intermediate transfer drum 3 and brought to contact only after it has got to a predetermined rotary speed as under the conditions (4) and (5).

However, this does not mean that the secondary transfer roller 11 needs to be brought into contact with the intermediate transfer drum 3 by detecting the rotary speed of the secondary transfer roller 11. No problem arises when the secondary transfer roller 11 is brought into contact with the intermediate transfer drum 3 0.2 sec. after turning ON the drive motor, which is selected by taking the initial stages of operation of the drive motor into consideration.

When the secondary transfer roller 11 is linked to a clutch for driving it as under the condition (4), it may be brought into contact with the intermediate transfer drum 3 after turning ON the clutch.

When the secondary transfer roller 11 is brought into contact with the intermediate transfer drum 3 under the condition (6) or (7), the drive load of the secondary transfer roller 11 can be kept small and hence no defective transfers occur if the blade cleaner 25 is separated from the secondary transfer roller 11. The blade cleaner 25 may be made to contact the secondary transfer roller 11 after the latter is brought into contact with the intermediate transfer drum 3.

It should be noted that the secondary transfer roller 11 can be particularly smeared in an area where it is initially brought into contact with the secondary transfer drum 3 because it is made to contact the intermediate transfer drum 3 in an area located before the front end of the sheet of paper.

In view of this fact, with the method of separating the blade cleaner 25 from the secondary transfer roller 11 when the latter is made to contact the secondary transfer drum 3, it is necessary to make the blade cleaner 25 contact the secondary transfer roller 11 and clean the latter before the part of the secondary transfer roller 11 that has initially been made to contact the intermediate transfer drum 3 gets to the cleaning position.

From the above description, it will be appreciated that, when the secondary transfer roller 11 is provided with a blade cleaner 25 and it is brought into contact with the intermediate transfer drum 3 in an operation, either the secondary transfer drum 11 should be driven to rotate before it contacts the intermediate transfer drum 3 or the blade cleaner 25 should be separated from the secondary transfer roller 11.

Figure 12:
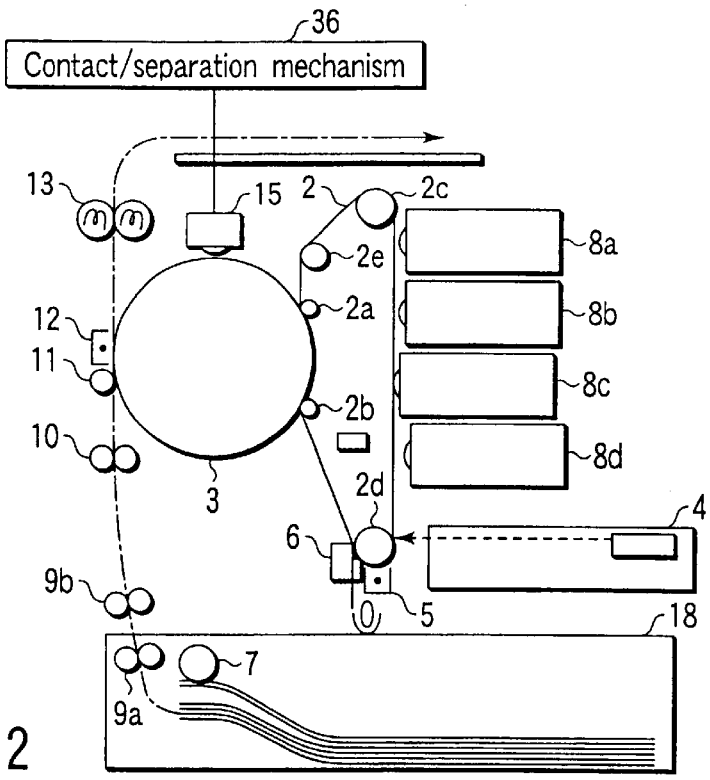
FIG. 12 is a schematic illustration of the inside of an electronic photocopying machine that is the third embodiment of the invention.

FIG. 12 is a schematic illustration of the inside of an electronic photocopying machine that is the third embodiment of the invention.

In FIG. 12, the components that are same as or similar to those of the first embodiment are denoted respectively by the same reference symbols and will not be described any further.

In the third embodiment, the intermediate transfer drum 3 is not provided with its own drive source and adapted to follow the rotary movement of the photosensitive belt 2 on the basis of the friction between itself and the photosensitive belt 2. The secondary transfer roller 11 is adapted to follow the rotary movement of the intermediate transfer drum 3. It is not provided with a cleaning means.

In the third embodiment, the photosensitive belt 2 may slip slightly on the intermediate transfer drum 3 when it starts moving. However, after getting to a predetermined rotary speed, it will move at the same rate as that at which the intermediate transfer drum 3 is driven to rotate and any color displacement can hardly occur.

Nevertheless, if the starting torque of the intermediate transfer drum 3 is excessively large, a large force intervenes between the photosensitive belt 2 and the intermediate transfer drum 3 when the intermediate transfer drum 3 starts moving. If the force comes repeatedly, the photosensitive belt 2 can be warped and lifted to give rise to defective transfers. The transfer body cleaner 15 has most to do with the starting torque of the intermediate transfer drum 3.

Figure 13:
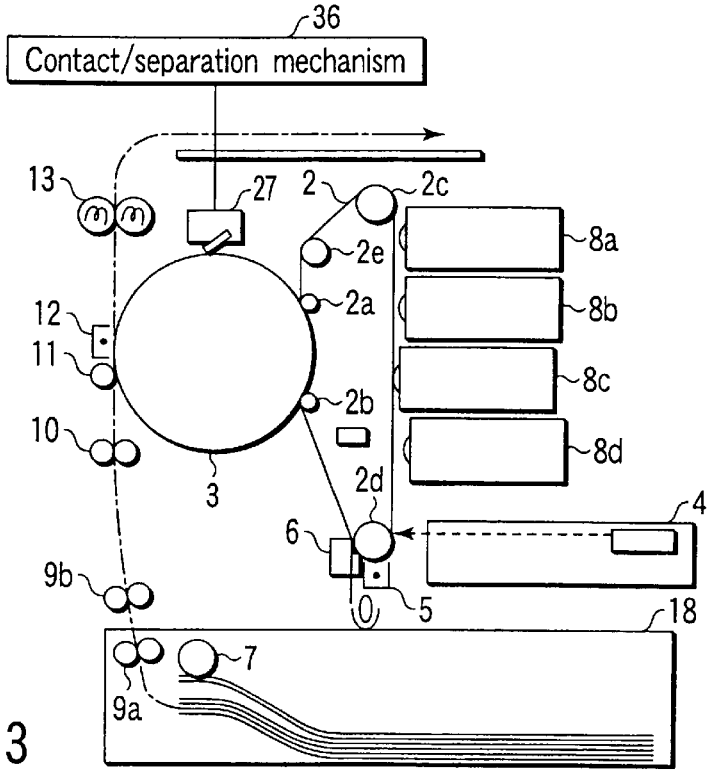
FIG. 13 is a schematic illustration of the inside of the embodiment, in which a blade is used as cleaner for the intermediate transfer body.

A brush cleaner is used for the transfer body cleaner 15 in FIG. 12, although it may be replaced by a blade cleaner 27 as shown in FIG. 13.

Sheets of paper were used one by one for intermittent printing with time intervals in a life operation under six cleaner conditions as illustrated in FIG. 14 to see the rate of occurrence of defective transfers. As seen from FIG. 14, a blade cleaner 27 is apt to give rise to defective transfers due to a warped rubber belt 22 because it involves a large load if compared with a brush cleaner 15. When the intermediate transfer drum 3 is made to start operating with the blade cleaner 27 held in contact with it, defective transfers can occur after printing 20 k sheets. However, when using the brush cleaner, defective transfers can occur after printing 30 k sheets if the photosensitive belt 2 is made to start moving after applying a bias voltage.

FIG. 15 illustrates the result obtained by observing the torque of the shaft of the intermediate transfer drum 3 when it was made to start moving under three different conditions including one where the blade cleaner 27 is held in contact with the intermediate transfer drum 3, one where the brush cleaner 15 is held in contact with the intermediate transfer drum 3 without applying the bias voltage and one where the brush cleaner 15 is held in contact with the intermediate transfer drum 3 with the bias voltage applied thereto.

By seeing FIG. 15, it will be appreciated that a large load is made to intervene by electrostatic force when the brush cleaner 15 is used with the bias voltage applied thereto. When the blade cleaner 27 is brought into contact with the intermediate transfer drum 3 before the photosensitive belt 2 and the intermediate transfer drum 3 are driven and get to a predetermined rotary speed, the rubber belt 22 becomes warped to produce defective transfers after printing a small number of sheets.

The data of FIG. 14 indicate that no problem arises in a life operation when the blade cleaner 27 is brought into contact with the intermediate transfer drum 3 after making the latter start moving. Generally, no problem arises when the blade cleaner 27 is brought into contact with the intermediate transfer drum 3 0.2 to 0.3 sec. after the start of the rotary movement of the intermediate transfer drum 3.

In the case of using the brush cleaner 15, more than 100 k sheets can be printed without defective transfers in a life operation when the intermediate transfer drum 3 is made to start moving without the bias voltage. However, a long service life can be realized when the intermediate transfer drum 3 is made to start moving with the brush cleaner 15 separated from it.

From the above, in a printing apparatus where the intermediate transfer drum 3 is made to follow the rotary movement of the photosensitive belt 2, no defective transfers arise after intermittently printing 100 k sheets one by one with time intervals when the photosensitive belt 2 is made to start moving with the cleaner 15 or 27 of the intermediate transfer drum 3 separated from the latter and the surface of the intermediate transfer drum 3 is cleaned by bringing the cleaner 15 or 27 into contact with the intermediate transfer drum 3 after the photosensitive belt 2 gets to a predetermined rotary speed.

Figure 16:
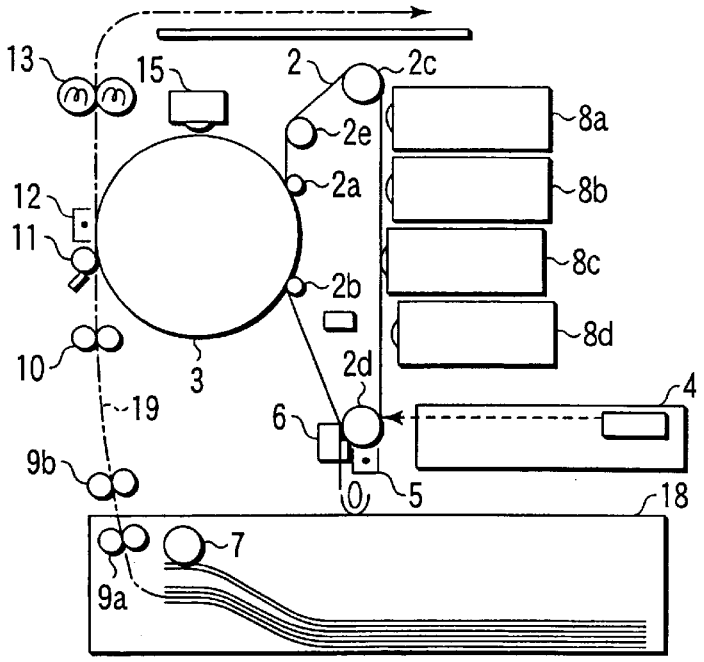
FIG. 16 is a schematic illustration of the inside of an electronic photocopying machine that is the fourth embodiment of the invention.

FIG. 16 is a schematic illustration of the inside of an electronic photocopying machine that is the fourth embodiment of the invention.

In FIG. 16, the components that are same as or similar to those of the first embodiment are denoted respectively by the same reference symbols and will not be described any further.

While the fourth embodiment has a configuration substantially the same as the first embodiment, it differs from the latter in that the secondary transfer roller 11 is provided at the opposite ends of its shaft with respective bearing rollers.

Additionally, the secondary transfer roller 11 is not provided with its own drive source and is adapted to follow the rotary movement of the intermediate transfer drum 3. Furthermore, it is provided with a blade cleaner 25. The secondary transfer roller 11 has a structure realized by coating a foamed urethane base member showing a hardness of 25° (ASKER-C) and a diameter of 20 mm with a 20 $\mu$m thick Teflon type resin tube.

When the secondary transfer roller 11 is simply made to follow the rotary movement of the intermediate transfer drum 3 and the blade cleaner 25 is brought into contact with the secondary transfer roller 11, there can be occasions where the secondary transfer roller 11 stops moving. When the secondary transfer roller 11 is made to contact with the intermediate transfer drum 3 under high pressure and driven forcibly, a large load is applied to the surface of the intermediate transfer drum 3 to warp the rubber belt 22 and give rise to defective transfers.

Considering these circumstances, in the fourth embodiment, the secondary transfer roller 11 is provided at the opposite ends of its shaft with respective bearing rollers 30, 30 and the bearing rollers 30, 30 are brought into contact with the respective outer peripheral surfaces of the base pipe 21 of the intermediate transfer drum 3. With this arrangement, the secondary transfer roller 11 can rotate under a stable condition with the cleaning blade 25 held in contact with it and no defective transfers occur due to a warped rubber belt 22 of the intermediate transfer drum 3.

FIGS. 17 through 20 illustrate four different modes in which the secondary transfer roller 11 is driven by the intermediate transfer drum 3.

Figure 17:
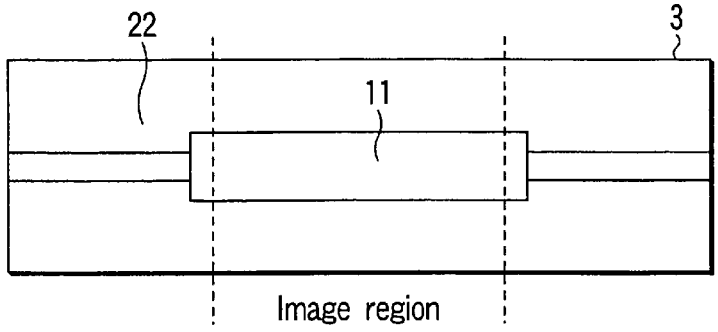
FIG. 17 is a schematic illustration of the secondary transfer roller that is brought into contact with the intermediate transfer drum.

FIG. 17 shows a mode in which the friction between the secondary transfer roller 11 and the intermediate transfer drum 3 is utilized. If the blade cleaner 25 is not provided, a sponge roller may be used for the secondary transfer roller 11. In such a case, the secondary transfer roller 11 rotates smoothly and no large load is applied to the surface of the intermediate transfer drum 3 so that no defective transfers occur due to a warped rubber belt 22.

If the secondary transfer roller 11 is provided with a blade cleaner 25, the secondary transfer roller 11 needs to be coated with a resin tube having a smooth surface and good toner releasing properties or be painted. Then, the coefficient of friction of the secondary transfer roller 11 falls and may no longer follow the rotary movement of the intermediate transfer drum 3 so that a jamming problem as shown in FIG. 21 can arise.

If a too large a weight is applied to the intermediate transfer drum 3 by the secondary transfer roller 11, inside blanks can occur in printed strips and defective transfers can arise due to a warped rubber belt in life operations. In short, in the mode of FIG. 17 where the secondary transfer roller 11 is made to follow the rotary movement of the intermediate transfer drum 3, it is not possible to find conditions under which problems such as inside blanks in printed strips, defective transfers in life operations and jams of sheets of paper do not occur.

Figure 18:
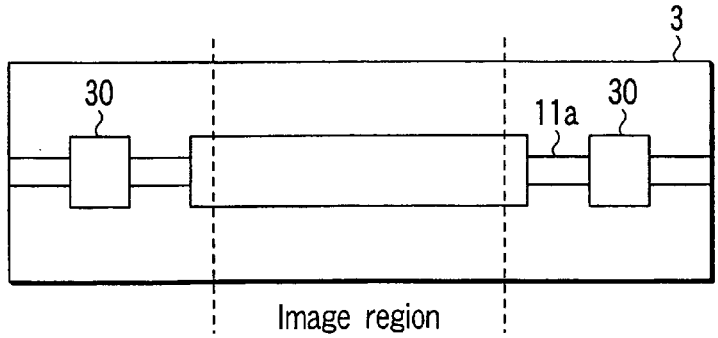
FIG. 18 is a schematic illustration of the bearing rollers coaxially connected to the secondary transfer roller and brought into contact with the elastic rubber belt of the intermediate transfer drum.

FIG. 18 shows a mode in which the rotary shaft 11*a* of the secondary transfer roller 11 is provided with bearing rollers 30, 30 at the opposite ends thereof. The bearing rollers 30, 30 are tacky and insulating or show resistance much higher than the secondary transfer roller 11. They are engaged with the rotary shaft 11*a* of the secondary transfer roller 11 by means of pins so that they rotate integrally with the rotary shaft 11*a*.

The bearing rollers 30, 30 need to have a diameter smaller than that of the secondary transfer roller 11 when they show a hardness level higher than the secondary transfer roller 11. They need to have a diameter substantially equal to that of the secondary transfer roller 11 when they show a hardness level substantially equal to the secondary transfer roller 11. Finally, they need to have a diameter greater than that of the secondary transfer roller 11 when they show a hardness level lower than the secondary transfer roller 11. This is because no sufficient drive force is obtained and jams can arise due to defective rotary movement of the secondary transfer roller 11 if the bearing rollers 30, 30 have a diameter smaller than that of the secondary transfer roller 11 and show a hardness level lower than the latter. On the other hand, a sufficient drive force can be obtained for the secondary transfer roller 11 if the bearing rollers 30, 30 have a diameter greater than that of the secondary transfer roller 11 and show a hardness level lower than the secondary transfer roller 11. However, the rubber belt 22 of the intermediate transfer drum 3 with which the bearing rollers 30, 30 contact can become lifted even in the image forming region thereof to give rise to defective transfers.

FIG. 22 shows the jams and the defective transfers observed in a life operation when the secondary transfer roller 11 of FIG. 18 was used with bearing rollers 30, 30 whose diameter and sponge hardness were made to vary. With any combination shown in FIG. 22, it was not possible to avoid both jams and defective transfers.

FIG. 19 shows a mode in which the width of the rubber belt 22 of the intermediate transfer drum 3 is made shorter than the axial dimension of the base pipe 21 to expose the outer peripheral surface of the aluminum base pipe 21 at the opposite ends thereof and the exposed sections 21*a*, 21*a* are made to contact the respective bearing rollers 30, 30 of the secondary transfer roller 11. If the resistance of the bearing rollers 30, 30 is low, the secondary transfer bias current flows to the aluminum base pipe 21 to make it impossible to generate a sufficiently strong electric field for transfer operations. Therefore, a material showing a resistivity higher than $10^{11}$ Ω·cm needs to be selected for the bearing rollers 30, 30. Additionally, the bearing rollers 30, 30 need to be treated to become tacky and show a high frictional resistance.

In this mode again, a high drive force can be obtained when the bearing rollers 30, 30 are made to have a diameter larger than that of the secondary transfer roller 11 and show a hardness higher than the latter. However, if the hardness is to high, the secondary transfer roller 11 no longer contacts the intermediate transfer drum 3 and defective transfers can occur from the very start of operation.

FIG. 23 shows the jams and the defective transfers observed in a life operation when the secondary transfer roller 11 of FIG. 19 was used with bearing rollers 30, 30 whose diameter and sponge hardness were made to vary.

It will be appreciated that a good result can be obtained in this mode by selecting appropriate values for the hardness and the diameter of the bearing rollers 30, 30 as a function of the hardness and the diameter of the secondary transfer roller 11.

FIG. 20 shows a mode in which the width of the rubber belt 22 of the intermediate transfer drum 3 is made shorter than the axial dimension of the aluminum base pipe 21 to expose the outer peripheral surface of the aluminum base pipe 21 at the opposite ends thereof and the exposed sections 21*a*, 21*a* are made to contact the respective bearing rollers 30, 30 of the secondary transfer roller 11 as in FIG. 19.

However, the bearing rollers 30, 30 of FIG. 20 are ordinary sponge rollers that are not tacky at all and the exposed sections 21*a*, 21*a* of the aluminum base pipe 21 with which the bearing rollers 30, 30 are held in contact have paint 21*b*, 21*b* applied that raises the coefficient of friction thereof. In this mode, more specifically, a paint prepared by adding a frictional resistance improving agent to a urethane paint is applied to the exposed sections 21*a*, 21*a* and the bearing rollers 30, 30 are made of foamed EPDM.

FIG. 24 shows the jams due to defective rotary movement of the secondary transfer roller 11, the defective transfers due to insufficient contact, and the defective transfers observed in a life operation when the secondary transfer roller 11 of FIG. 20 was used with bearing rollers 30, 30 whose diameter and sponge hardness were made to vary.

It will be appreciated that a good result can be obtained in this mode by selecting appropriate values for the hardness and the diameter of the bearing rollers 30, 30 as a function of the hardness and the diameter of the secondary transfer roller 11.

Figures 30, 31:
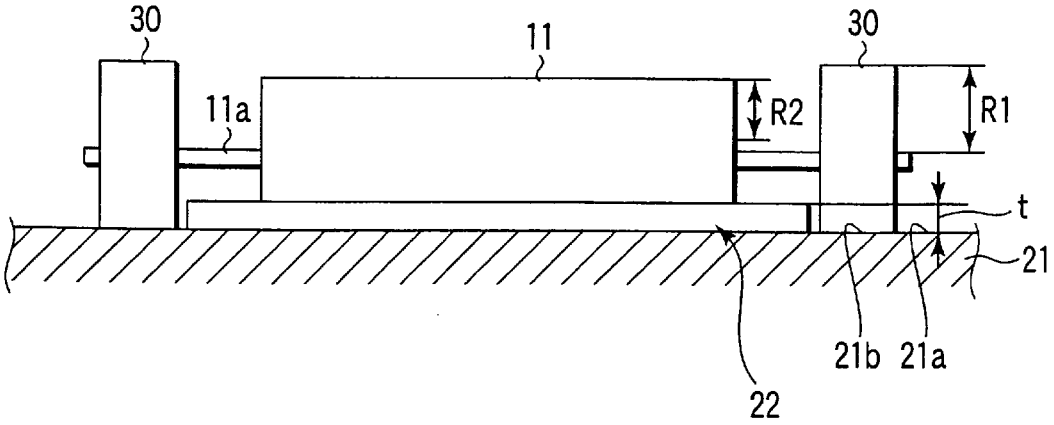
FIG. 30 is a chart illustrating the effect of the width and the depth of the knurls and the hardness of the rubber belt on the transfer performance.
FIG. 31 is a schematic view taken along line A—A in FIG. 20.

FIG. 31 is a schematic cross-sectional view taken along line A—A in FIG. 20.

If the radius of the bearing rollers 30, 30 is R1, the radius of the secondary transfer roller 11 is R2 and the thickness of the rubber belt 22 is t, no sufficient transfer nip can be obtained when R1≈R2+t.

Additionally, wrinkles can appear on the rubber belt when the hardness of the bearing rollers 30, 30 is greater than the hardness of the secondary transfer roller 11 because the friction between the secondary transfer roller 11 and the rubber belt 22 and hence the load of the rubber belt 22 become too large.

If the hardness of the bearing rollers 30, 30 is substantially equal to that of the secondary transfer roller 11 (and the difference is not greater than 100), the load of the bearing rollers 30, 30 is large due to the high $\mu$ treatment of the base pipe 21. Then, the load between the secondary transfer roller 11 and the rubber belt 22 is reduced. A better effect can be obtained when the surface of the secondary transfer roller 11 is covered by a tube or coated with paint.

No sufficient transfer nip is obtained nor satisfactory transfers take place when R1>R2+t and the hardness of the bearing rollers 30, 30≈ the hardness of the secondary transfer roller 11 or the hardness of the bearing rollers 30, 30 is greater than the hardness of the secondary transfer roller 11. The requirement of the hardness of the bearing rollers 30, 30 is less than the hardness of the secondary transfer roller 11 needs to be indispensably met.

No sufficient drive force can be obtained if the exposed sections 21*a*, 21*a* of the base pipe 21 is subjected to a high g treatment when R1<R2+t and the hardness of the bearing rollers 30, 30 is less than the hardness of the secondary transfer roller 11. As a result, wrinkles can appear due to the large frictional load between the secondary transfer roller 11 and the rubber belt 22.

Although a favorable result may be obtained depending on the high $\mu$ treatment when the hardness of the bearing rollers 30, 30≈ the hardness of the secondary transfer roller 11, most desirably the requirement of the hardness of the bearing rollers 30, 30 is greater than the hardness of the secondary transfer roller 11 is met.

Figure 25:
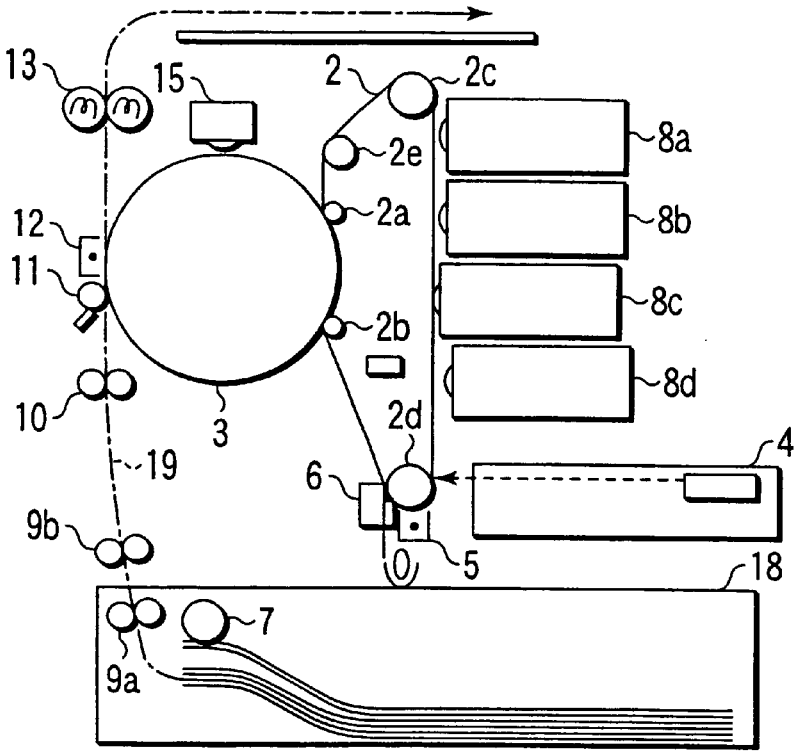
FIG. 25 is a schematic illustration of the inside of an electronic photocopying machine that is the fifth embodiment of the invention.

FIG. 25 schematically illustrates the fifth embodiment of the invention.

Note that the components that are same as or similar to those of the first embodiment are denoted respectively by the same reference symbols and will not be described any further. This embodiment has a machine configuration substantially same as the first embodiment.

However, this embodiment differs from the first embodiment in terms of the process speed which is as high as 360 mm/sec. (20 PPM for color and 80 PPM for black and white) if compared with the process speed of 180 mm/sec. of the first through fourth embodiments.

In such a high speed machine, the consumables are required to show a long service life. Particularly, the intermediate transfer drum 3 is required to show a service life of more than 500 k sheets. A tight contact is required between the base pipe 21 of the intermediate transfer drum 3 and the rubber belt 22 because of the high printing speed.

A brush cleaner 15 is used for the transfer body cleaner in order to minimize the load applied to the surface of the rubber belt 22. The brush cleaner 15 is separated from the intermediate transfer drum 3 when the latter is driven to start moving and brought into contact with and clean the latter a second after the start of driving the intermediate transfer drum 3.

A single drive motor 20 is used to drive both the photosensitive belt 2 and the intermediate transfer drum 3 as in the case of the first embodiment.

A blade cleaner 25 is held in contact with the secondary transfer roller 11 and the secondary transfer roller 11 is brought into contact with the intermediate transfer drum 3 after driving the secondary transfer roller 11.

The secondary transfer roller 11 has a structure formed by coating a foamed urethane base member showing a hardness of 25° (ASKER-C) and a diameter of 20 mm with a Teflon type resin tube (20 $\mu$m thick). An intermediate transfer drum 3 prepared by coating an aluminum base pipe (without surface treatment) with a rubber belt 22 showing a volume resistivity of $10^{10}$ Ω·cm, a hardness of 70°, a thickness of 0.5 mm and a 100% tensile stress of 280 g/cm$^2$. The rubber belt 22 is drawn with a drawing ratio of P=1, 12 and put on the base pipe without using any adhesive agent. In an experiment, defective transfers appeared due to a warped rubber belt 22 after printing 200 k sheets in a life printing operation of intermittently printing on a one by one basis with time intervals.

Figure 26:
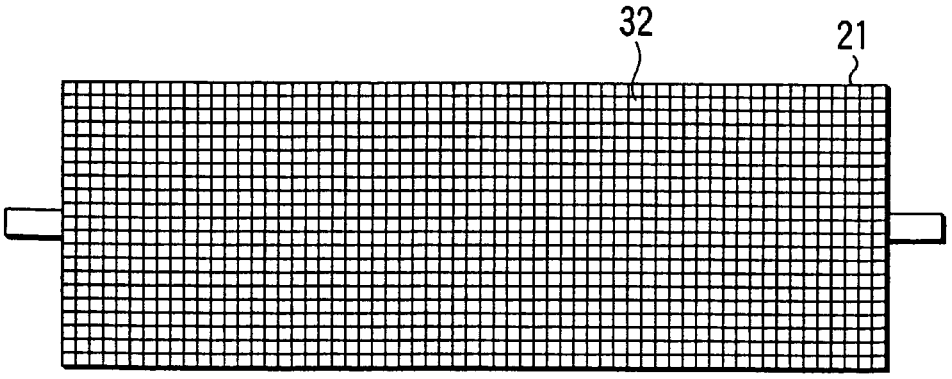
FIG. 26 is a schematic illustration of knurls formed on the surface of the base pipe of the intermediate transfer drum of the embodiment.

In view of this fact, knurls 32 are formed on the aluminum base pipe 21 as shown information in FIG. 26 to improve the adhesion of the rubber belt 22 to the base pipe 21. However, the adhesion can be reduced to give rise to defective transfers in a life operation if the knurls are too shallow and/or too narrow or inversely too deep and/or too wide because the contact area between the rubber belt 22 and the base pipe 21 decreases.

If the hardness of the rubber belt 22 is too high, it can hardly be deformed to adapt itself to the surface profile of the knurls 32 so that consequently the adhesiveness can be reduced. If, on the other hand, the hardness of the rubber belt 22 is too low, its adhesiveness is reduced to give rise to defective transfers.

Intermediate transfer drums 3 were prepared by changing the parameters including the hardness of the rubber belt 22, the depth, the width and the pitch of arrangement of the knurls 32 and subjected to a test in a life operation to look into the occurrence of defective transfers due to a warped rubber belt 22.

Firstly, the effect of the pitch of arrangement of the knurls 32 was checked. A rubber belt A showing a hardness of 780, a thickness of 0.5 mm and a 100% tensile stress of 280 g/cm$^2$ and a rubber belt B showing a hardness of 63°, a thickness of 0.5 mm and a 100% tensile stress of 140 g/cm$^2$ were used and drawn under a condition of P=1. /2. The knurls 32 had a width and a depth equal to 100 $\mu$m. FIG. 27 shows the obtained result.

When the pitch of arrangement of the knurls 32 is too small and the hardness of the rubber belt 22 is high, the deformation of the rubber belt 22 does not match the pitch of arrangement of the knurls 32 to consequently reduce its adhesiveness relative to the base pipe 21 and give rise to defective transfers. When, on the other hand, the pitch of arrangement of the knurls 32 exceeds 20 mm, they do not provide any effect. Therefore, the pitch of arrangement of knurls 32 needs to be between 2 and 20 mm.

Then, the effect of the depth and that of the width of the knurls 32 were checked.

Two different pitches of arrangement of 2 mm and 20 mm were used with varied depth and width and the occurrence of defective transfers in a life operation and those due to insufficient adhesiveness of the rubber belt 22 relative to the base pipe 21 was observed from the beginning.

FIG. 28 shows the effect of the width of the knurls when the depth thereof was invariably held to 0.1 mm. It was found that the width of the knurls 32 affects the occurrence of defective transfers in the initial stages of operation but does not affect significantly the occurrence of defective transfers in a life operation. The knurls 32 operate when the width is between 0.05 and 1 mm.

FIG. 29 shows the effect of the depth of the knurls when the width thereof was invariably held to 0.2 mm. The knurls 32 operate well when the depth is between 0.05 and 0.2 mm.

FIG. 30 shows a result obtained for defective transfers when the pitch of arrangement of the knurls 32 was invariably held to 5 mm but the width and the depth of the knurls were made equal to either 0.05 mm and 0.05 mm respectively or 1 mm and 0.2 mm respectively.

Defective transfers hardly occur in the initial stages of operation if the rubber belt 22 shows a high hardness when the knurls 32 have a small width and a small depth. However, when the knurls 32 have a large width and a large depth, the rubber belt 22 cannot adapt itself to the grooves and spaces can be produced between the base pipe 21 and the rubber belt 22 so that the transfer electric field and the transfer pressure become insufficient to give rise to defective transfers in the transfer nip.

As for defective transfers in a life operation, the rubber belt 22 is lifted to produce defective transfers when the hardness of the rubber belt 22 is low.

From the above, a good transfer performance can be realized without defective transfers throughout a life operation when a rubber belt showing a hardness of 60 to 80° (JIS-A) and having knurls that are arranged at a pitch of 2 to 20 mm and have a width of 0.05 to 1 mm and a depth of 0.05 to 2 mm is used.

Additional advantages and modifications will readily occur to those skilled in the art. Therefore, the invention in its broader aspect is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image forming device which forms an image of a developing agent on an image carrier;

a freely rotatable intermediate transfer body having a transfer region operating as target of transfer of the developing agent image formed by said image forming device; and a freely rotatable transfer roller which transfers the developing agent image transferred to said intermediate transfer body further to a final target of transfer; said transfer roller being adapted to rotate as said intermediate transfer body rotates;

said intermediate transfer body including a base pipe and an elastic belt, said base pipe being coated with said elastic belt without being adhered thereto;

said elastic belt being adapted to expose the outer peripheral area of said base pipe, except the transfer region;

bearing rollers being coaxially connected to said transfer roller and adapted to contact said exposed outer peripheral area.

2. The apparatus according to claim 1, wherein said exposed outer peripheral area of said base pipe is as high friction area and said bearing rollers are made to contact the high friction area.

3. The apparatus according to claim 1, wherein a hardness and diameter of said bearing rollers are selected in accordance with the diameter and hardness of said transfer roller.

4. An image forming apparatus comprising:

an image forming device which forms an image of a developing agent on an image carrier;

an intermediate transfer body to which the developing agent image formed by said image forming device is to be transferred; and a transfer roller which transfers the developing agent image transferred to said intermediate transfer body further to a final target of transfer;

said intermediate transfer body including a base pipe carrying knurls on the surface and an elastic belt having a hardness of 60 to 80°, said base pipe being coated with said elastic belt without being adhered thereto;

said knurls having values of 1=2 to 20 mm, d=0.05 to 1 mm and W=0.05 to 0.2 mm, where 1 is the pitch of arrangement of said knurls, d and W are respectively the depth and the width of each of said knurls.

* * * * *